US008783452B2

(12) United States Patent
Thoman et al.

(10) Patent No.: US 8,783,452 B2
(45) Date of Patent: Jul. 22, 2014

(54) BOTTLE WITH DISPENSING DEVICE

(75) Inventors: Federico Thoman, Milan (IT); Stefano Thoman, Milan (IT)

(73) Assignee: Coswell S.p.A., Bologna (IT)

( * ) Notice: Subject to any disclaimer, the term of this patent is extended or adjusted under 35 U.S.C. 154(b) by 0 days.

(21) Appl. No.: 13/983,359

(22) PCT Filed: Feb. 10, 2012

(86) PCT No.: PCT/IB2012/000277

§ 371 (c)(1),
(2), (4) Date: Aug. 2, 2013

(87) PCT Pub. No.: WO2012/117281

PCT Pub. Date: Sep. 7, 2012

(65) Prior Publication Data

US 2013/0313138 A1 Nov. 28, 2013

(30) Foreign Application Priority Data

Feb. 16, 2011 (IT) ..... MI20110054 U

(51) Int. Cl.
*B65D 51/28* (2006.01)

(52) U.S. Cl.
USPC ..... 206/222; 206/219

(58) Field of Classification Search
CPC ..... B65D 51/2835; B65D 51/2814; B65D 51/2807; B65D 81/3211; B65D 81/32; B65D 81/3222; B65D 81/3205; A61J 1/2093
USPC ..... 206/222, 219, 220, 221, 568; 215/DIG. 8; 220/521
See application file for complete search history.

(56) References Cited

U.S. PATENT DOCUMENTS 3,156,369 A * 11/1964 Bowes et al. ..... 206/222
4,221,291 A 9/1980 Hunt
4,982,875 A * 1/1991 Pozzi et al. ..... 222/83

(Continued)

FOREIGN PATENT DOCUMENTS

EP 0344849 A2 12/1989
IT MI2008U000156 4/2008

(Continued)

OTHER PUBLICATIONS

PCT International Search Report dated Jun. 22, 2012.

(Continued)

*Primary Examiner* — Steven A. Reynolds
(74) *Attorney, Agent, or Firm* — Husch Blackwell LLP

(57) ABSTRACT

A bottle with a dispensing device includes a cap having a female screw; a tubular element, coaxial with the female screw, having a lower end, which is closed by a bottom wall and projects inside the neck of the bottle; and a collar joined to the top of the tubular element through a tear-away. A hollow piston having an open lower end is inserted in the tubular element and is suitable for breaking through the bottom wall of the cap after the collar together with the tear-away ring has been removed. The hollow piston and bottom wall of the tubular element define a chamber containing a product. The lower end of the hollow piston has an inclined profile. Means are provided to stop the stroke of the hollow piston before the bottom wall completely detaches and prevent the hollow piston from rotating at the end of its stroke.

3 Claims, 3 Drawing Sheets

(56) References Cited

U.S. PATENT DOCUMENTS

| | | | | |
|---|---|---|---|---|
| 5,782,345 | A * | 7/1998 | Guasch et al. | 206/222 |
| 5,927,549 | A | 7/1999 | Wood | |
| 6,148,996 | A * | 11/2000 | Morini | 206/222 |
| 6,705,462 | B2 * | 3/2004 | Kasuya | 206/222 |
| 7,347,322 | B2 * | 3/2008 | Cho | 206/222 |
| 7,475,774 | B2 * | 1/2009 | Clarkson | 206/222 |
| 7,607,549 | B2 * | 10/2009 | Morini | 215/297 |
| 7,635,012 | B2 * | 12/2009 | Johns et al. | 141/322 |
| 7,748,550 | B2 * | 7/2010 | Cho | 215/228 |
| 8,215,481 | B1 * | 7/2012 | Knickerbocker | 206/222 |
| 8,387,786 | B2 * | 3/2013 | Fontana | 206/221 |
| 8,403,131 | B2 * | 3/2013 | Rovelli | 206/222 |
| 2002/0020636 | A1 * | 2/2002 | Bergamini et al. | 206/219 |
| 2005/0161348 | A1 * | 7/2005 | Morini | 206/219 |
| 2006/0144727 | A1 * | 7/2006 | Fontana | 206/222 |
| 2008/0093326 | A1 * | 4/2008 | Cho | 215/228 |
| 2008/0124432 | A1 * | 5/2008 | Ma | 426/115 |
| 2010/0282624 | A1 * | 11/2010 | Paganuzzi | 206/222 |
| 2011/0266171 | A1 * | 11/2011 | Rovelli | 206/222 |
| 2012/0199503 | A1 * | 8/2012 | Dyrbye et al. | 206/222 |

FOREIGN PATENT DOCUMENTS

| | | | |
|---|---|---|---|
| JP | 2005-022706 | | 1/2005 |
| JP | 2006-103696 | | 4/2006 |
| JP | 3153904 | | 9/2009 |
| JP | 2011-500473 | | 1/2011 |
| WO | 02/36065 | A1 | 5/2002 |
| WO | 03/099673 | A1 | 12/2003 |
| WO | 2007/145772 | A2 | 12/2007 |
| WO | 2009/055311 | A1 | 4/2009 |

OTHER PUBLICATIONS

Japanese Office Action and English Translation dated Jan. 28, 2014.

* cited by examiner

BOTTLE WITH DISPENSING DEVICE

CROSS REFERENCE

This application claims priority to PCT Application No. PCT/IB2012/000277, filed 10 Feb. 2012 and to Italian Application No. MI 2011 U 00054 filed Feb. 16, 2011, both of which are incorporated by reference herein in their entirety.

TECHNICAL FIELD OF THE INVENTION

A bottle with a dispensing device, which makes it possible to keep a substance to be mixed separate from another substance in a bottle, is herein described.

BACKGROUND OF THE INVENTION

It is known to use products in granular or powder form, for example freeze-dried products, such as tea, orange flavoured soft drinks, coffee etc. which are added to water at the moment of consumption.

In particular, bottles are known, filled with water or other liquids, having a dispensing device containing a product in the form of granules or powder to be added to water so as to obtain a beverage instantly.

For example U.S. Pat. No. 4,221,291, discloses a bottle having a dispensing cap that is suitable for releasing into the bottle a content in the form of granules or powder.

Application MI 2008 U 0000156 discloses a bottle with a threaded neck on which a cap is screwed, said cap defining a chamber in which a hollow piston containing a product in the form of granules or powder is inserted.

By pushing the piston the breaking of a bottom wall is caused and the content of the hollow piston is consequently released in the bottle.

The solutions currently known have, however, some drawbacks.

For example, the device disclosed in patent application MI 2008 U 0000156 has the drawback of the bottom wall of the cap being able to fall into the bottle creating a situation of danger for the person drinking the content of the bottle.

SUMMARY OF THE INVENTION

The purpose of the invention is that of proposing a solution which solves at least part of the drawbacks of the prior art and in particular the aforementioned drawback.

Yet another purpose of the invention is that of proposing a solution which can be easily implemented, used on bottles already on the market, cost-effective and easy to use for the end users.

Said task is solved by a bottle according to claim 1. Preferred features of the invention are disclosed in claim 2.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

A possible embodiment of the claimed bottle is described herein with reference to the attached drawing sheets, wherein similar reference characters indicate the same parts throughout the views, in which:

DETAILED DESCRIPTION

Figure 1:
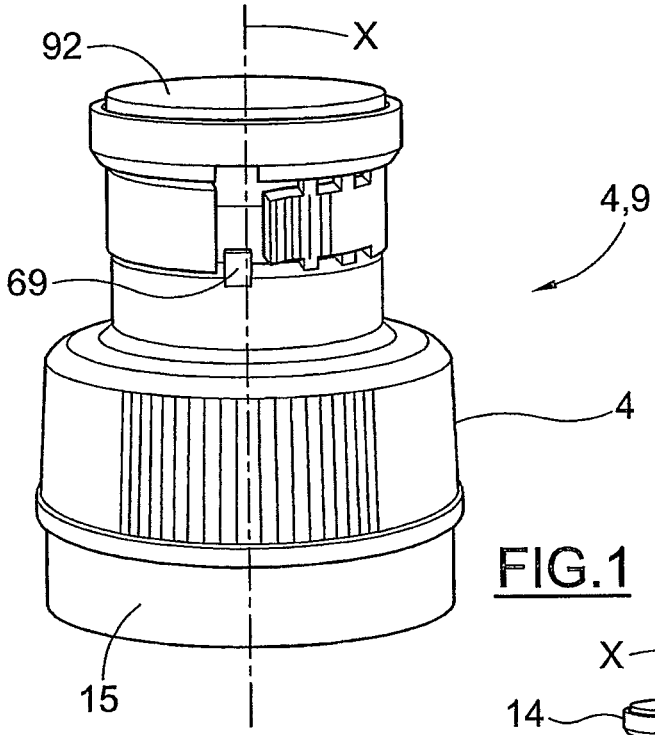
FIG. 1 is a view of a dispensing device for a bottle before being used.
Figure 2:
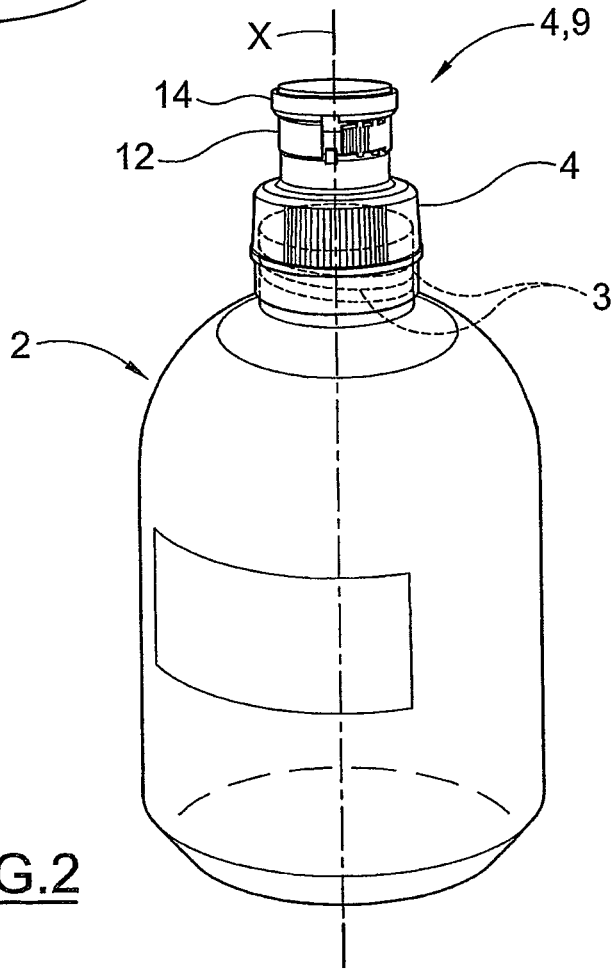
FIG. 2 shows a bottle equipped with the dispensing device of FIG. 1.
Figure 3:
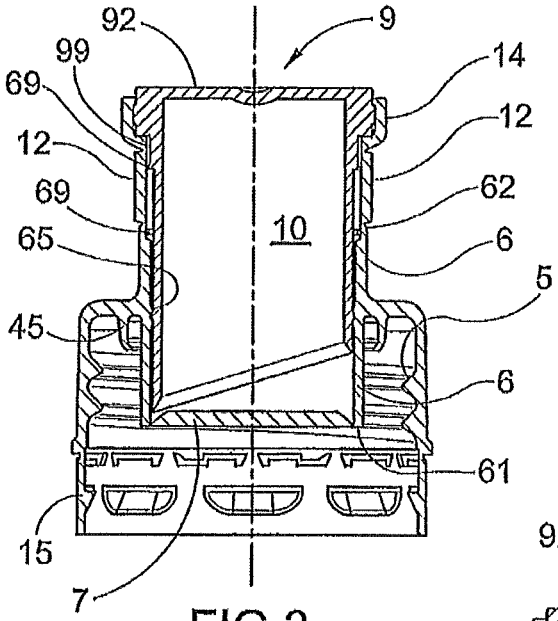
FIG. 3 is a section view of the same device as FIG. 1.
Figure 4:
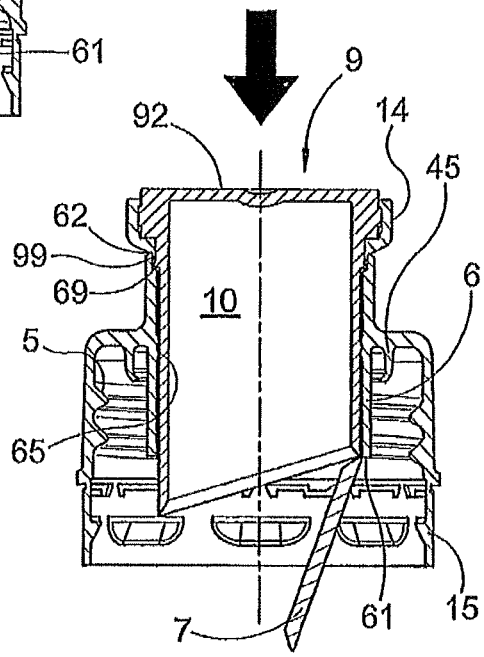
FIG. 4 is a section view analogous to FIG. 3, showing the device during its use, i.e. during the release inside a bottle of a product in the powder, granular or liquid form contained in the device.
Figure 5:
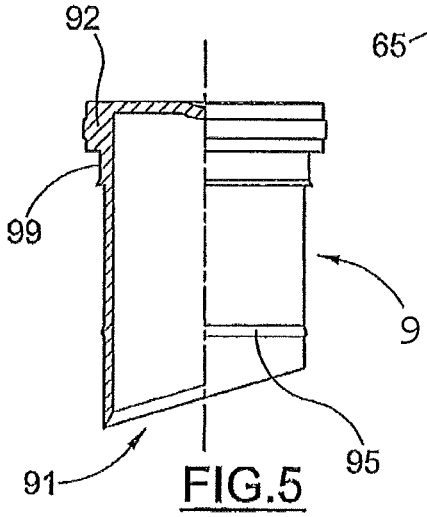
FIG. 5 shows a detail of the device of FIGS. 1, 3 and 4.
Figure 6:
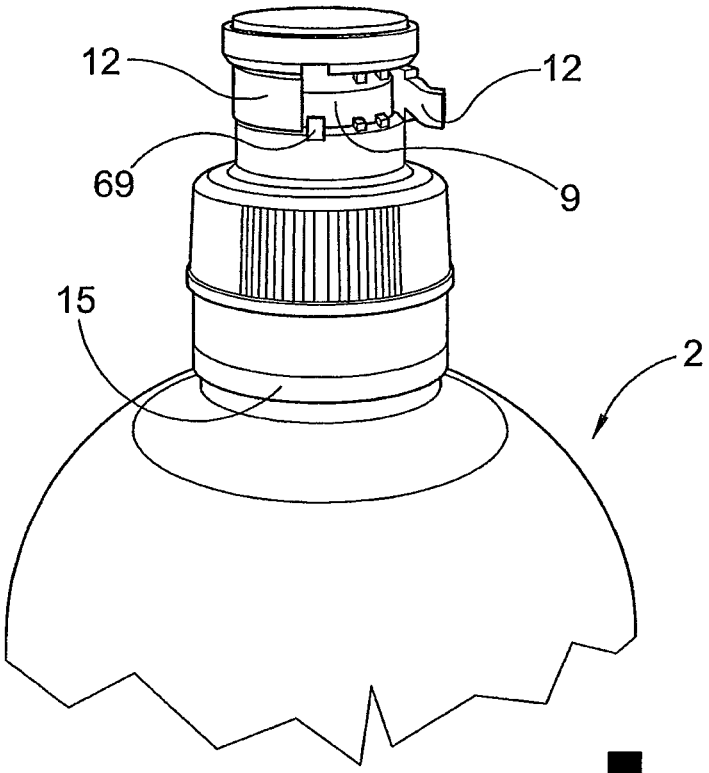
FIGS. 6 and 7 show a portion of bottle equipped with the dispensing device of FIG. 1, showing the device during its use, i.e. during the tear of a tear-away ring (FIG. 6) and during the release inside the bottle of a product in the powder, granular or liquid form contained in the device (FIG. 7).
Figure 7:
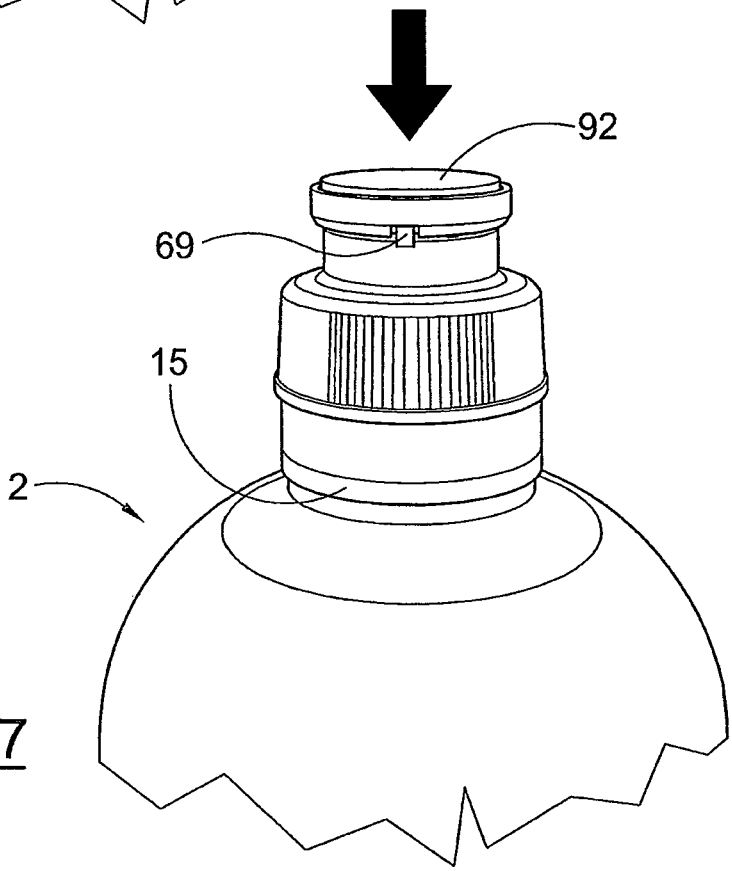

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

Reference numeral 2 indicates a bottle, extending along an axis of extension X, containing water or a water based solution. The bottle 2 can be a conventional bottle made from PET (or a container made from other material) of the type with a threaded neck 3 and has a dispensing device 4, 9, that is suitable for releasing a product, for example a powder product, inside the bottle itself. The threaded neck 3 can be of the BPF/PCO type or of the 3-threading ends type or of another standard normally used in the production of bottles made from PET, or of any other standard used for the threading of a neck of any container.

The dispensing device 4, 9 comprises a cap 4 with a female screw 5, which is screwed onto the neck 3 of the bottle 2 and is coaxial to the axis of extension X of the bottle 2. The cap 4 also comprises a generically tubular element 6, substantially and/or generically coaxial with the female screw 5, which is joined to the female screw 5 by means of a connection element 45 in the shape of a circular crown.

The tubular element 6 has a lower end 61 inside the female screw 5, which projects inside the neck 3 of the bottle 2, and an upper end 62 which comes out from the female screw 5. The tubular element 6 has, at the lower end 61, a bottom wall 7, extending on a plane that is substantially perpendicular with respect to the axis X. The upper portion 62 of the tubular element 6 ends with a collar 14 that is joined to the tubular element 6 by means of a tear-away ring 12.

There is also a hollow piston 9 which is inserted into the tubular element 6, the hollow piston 9 having an open lower end 91 and a closed head 92. The collar 14 has an inner profile that matches that of the head 92 of the hollow piston 9 so as to house the head 92 of the piston 9 preventing an accidental forward movement thereof. On the outer surface of the piston there is at least one circular protrusion 95 that is suitable for interfering with at least one circular protrusion 65 formed in the inner surface of the tubular element 6 so as to prevent it from accidentally coming out.

The hollow piston 9 defines, together with the bottom wall 7 of the tubular element 6, a chamber 10 containing a product, for example a product in the powder, granular or liquid form, intended to be released inside the bottle. For such a purpose the hollow piston 9 is suitable for breaking through the bottom wall 7 of the tubular element 6 of the cap 4, so as to allow the content to be released inside the bottle 2.

In order to push the piston 9 and break through the bottom wall 7 of the cap 4, it is necessary to first tear the tear-away ring 12 and to remove the tear-away ring 12, so as to lower the upper edge of the tubular element 6. The lower end 91 of the hollow piston 9 has a profile that is substantially and/or generally inclined, with respect to the plane defined by the bottom wall 7. This characteristic allows a progressive opening of the bottom wall to be achieved, like a rotating door.

Means 69, 99 are also provided that are suitable for stopping the stroke of the hollow piston 9—before the complete detachment of the bottom wall 7—preventing not only the axial movement but also the rotation of the piston. The bottom wall 7 thus remains joined to the lower end 61 of the tubular element 6 of the cap 4 through a circular portion of at least 15 degree which acts as a hinge. Stopping the rotation of the hollow piston 9 prevents less experienced users, when rotating the piston 9, from making the bottom wall 7 of the tubular element 6 totally detach and thus fall into the bottle.

In the illustrated embodiment, the means 69, 99 that are suitable for stopping the hollow piston 9 consist of a circular groove 99, arranged under the head 92 of the hollow piston 9, the groove 99 being engaged by a tooth 69 which projects from the upper edge of the tubular element 6. The tooth 69 prevents the piston 9 from being extracted and from rotating, thus preventing the complete detachment of the bottom wall 7 which would otherwise fall into the bottle 2.

The bottom wall 7 can have an annular portion on the outer edge with a small thickness so as to facilitate the operation of breaking through.

The lower end of the piston 9 can have a profile shaped like the blade of a knife so as to further facilitate the breaking through of the bottom wall 7.

After the product is released into the bottle 2, the cap 4 can be unscrewed so as to allow the user to pour the content of the bottle 2 into a glass.

The female screw 5 of the cap 4 can be joined, in a detachable manner, to a ring 15 that is connected to the neck 3 of the bottle 2. The ring 15 performs the function of a tamper-proof seal, since it confirms that the bottle 2 has not been previously opened.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiment, but should be defined only in accordance with the following claims appended hereto and their equivalents.

The invention claimed is:

1. A bottle with a threaded neck having a dispensing device for releasing a product inside said bottle, said dispensing device comprising:

a) a cap having a1) a female screw screwed onto the threaded neck of said bottle;

a2) a generally tubular element, coaxial with said female screw, having a lower end which projects inside the neck of the bottle, said lower end being closed by a bottom wall;

a3) a collar joined to the top of said generally tubular element through a tear-away ring;

b) a hollow piston inserted in said tubular element;

b1) the hollow piston having an open lower end and a head suitable for being housed in said collar;

b3) the hollow piston being suitable for breaking through said bottom wall of said cap after the tear-away ring is removed and the hollow piston is pushed linearly and downwardly without substantial rotational movement;

b4) the hollow piston defining, together with said bottom wall of said generally-tubular element, a chamber containing a product intended to be released in said bottle;

wherein the lower end of said hollow piston has a generally inclined profile with respect to the plane defined by said bottom wall;

elements are provided which are suitable for stopping the stroke of said hollow piston before a complete detachment of the bottom wall occurs and for preventing said hollow piston from rotating at the end of its stroke.

2. The bottle, according to claim 1, wherein said elements suitable for stopping the stroke of the piston and for preventing the hollow piston from rotating at the end of the stroke comprise:

a circular groove arranged below the head of the hollow piston, a tooth which projects from the upper edge of the generally tubular element.

3. The bottle according to claim 1, wherein said generally inclined profile is shaped like a knife blade.

* * * * *